US011603624B2

(12) United States Patent
Heiniger et al.

(10) Patent No.: US 11,603,624 B2
(45) Date of Patent: Mar. 14, 2023

(54) LINT FILTER CLOGGING DETECTION IN A DRYER APPLIANCE BASED ON AIRFLOW

(71) Applicant: Haier US Appliance Solutions, Inc., Wilmington, DE (US)

(72) Inventors: Sarah Heiniger, Louisville, KY (US); David Scott Dunn, Louisville, KY (US); Jivko Ognianov Djerekarov, Louisville, KY (US); Ionelia Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 280 days.

(21) Appl. No.: 17/117,952

(22) Filed: Dec. 10, 2020

(65) Prior Publication Data

US 2022/0186424 A1 Jun. 16, 2022

(51) Int. Cl.

| | |
|---|---|
| ***D06F 58/50*** | (2020.01) |
| ***D06F 58/22*** | (2006.01) |
| ***D06F 58/38*** | (2020.01) |
| *D06F 103/32* | (2020.01) |
| *D06F 105/62* | (2020.01) |
| *D06F 103/36* | (2020.01) |
| *D06F 105/34* | (2020.01) |
| *D06F 105/58* | (2020.01) |
| *D06F 103/34* | (2020.01) |

(52) U.S. Cl.

CPC ..... *D06F 58/50* (2020.02); *D06F 58/22* (2013.01); *D06F 58/38* (2020.02); *D06F 2103/32* (2020.02); *D06F 2103/34* (2020.02); *D06F 2103/36* (2020.02); *D06F 2105/34* (2020.02); *D06F 2105/58* (2020.02); *D06F 2105/62* (2020.02)

(58) Field of Classification Search

CPC ..... D06F 58/50; D06F 58/22; D06F 58/38; D06F 58/20; D06F 2103/32; D06F 2103/34; D06F 2103/36; D06F 2105/34; D06F 2105/58; D06F 2105/62; D06F 2105/24; D06F 34/26; D06F 34/18

USPC ..... 34/82, 480

See application file for complete search history.

(56) References Cited

U.S. PATENT DOCUMENTS

2021/0095418 A1* 4/2021 Masters ..... D06F 58/26

FOREIGN PATENT DOCUMENTS

| | | | |
|---|---|---|---|
| CN | 110093767 | B | 5/2020 |
| EP | 0512940 | A1 | 11/1992 |
| EP | 2333149 | B1 | 11/2013 |
| JP | 2019/042411 | A | 3/2019 |
| KR | 2003/0008647 | A | 1/2003 |
| KR | 100751132 | B1 | 8/2007 |
| KR | 100756446 | B1 | 9/2007 |

* cited by examiner

*Primary Examiner* — John P Mccormack
(74) *Attorney, Agent, or Firm* — Dority & Manning, P.A.

(57) ABSTRACT

A laundry appliance uses a determination of volumetric airflow rate after a steady state condition is reached to determine the accumulation of lint in filter. Based on the determination, various actions can be taken including notifying the user, shutting off the appliance, initiating an automatic cleaning sequence for one or more lint filters, and combinations thereof. One or more temperature sensors, relative humidity sensors, and weight sensors are used to provide measurements for determining the volumetric airflow rate.

20 Claims, 8 Drawing Sheets

LINT FILTER CLOGGING DETECTION IN A DRYER APPLIANCE BASED ON AIRFLOW

FIELD OF THE INVENTION

The subject matter of the present disclosure relates generally to dryer appliance for laundry and more particularly to the detection of lint filter clogging in a dryer appliance.

BACKGROUND OF THE INVENTION

Generally, a dryer appliance provides for drying wet articles of laundry usually after a washing process. The articles may include e.g., clothing, linens, and other items. The wet articles are placed into a compartment or drum through which heated air is passed in order to capture and remove moisture (e.g., water) from the articles. Depending on the type of dryer, the moisture-laden air may be vented in order to remove moisture from the appliance. Alternatively, the air may be recirculated after being cooled, which causes the water vapor present to condense so that it may be removed.

The circulated air is usually filtered in order to remove lint, which is an accumulation of textile fibers and other materials that may be released from the laundry articles during the drying process. One or more such filters may be utilized in the dryer appliance. As the lint accumulates, the filter must be periodically cleaned. Some laundry articles e.g., may shed more lint during a drying cycle thereby loading the filter more quickly. The frequency of cleaning required depends upon several variables including the materials from which the laundry articles were created and the frequency of use of the appliance.

As the amount of lint in the filter increases, the pressure drop of air passing through the filter also increases. This pressure drop may increase gradually or may occur more quickly. For example, the pressure drop may increase over the course of several drying cycles if the user neglects to regularly clean the filter or a particular high-lint-shedding laundry load may clog the filter during a drying cycle. In appliances having an auto-cleaning filter, residual lint may simply accumulate over time even though the filter is automatically cleaned or if the auto cleaning cycle is not entirely effective.

Regardless, the increased pressure drop is undesirable because the concomitant reduction in air flow leads to increased drying times and, therefore, lower energy efficiency. The reduced air flow can also lead to undesirable overheating of the inlet air to the drum. For a dryer that uses a heat pump cycle, the reduced air flow may lead to overheating of the compressor, which can also undesirably heat the space where the appliance is located such as a laundry room of the user.

Conventional systems for detecting whether a lint filter needs cleaning have shown limited effectiveness. Such are sometimes based primarily on temperature measurements and can lack sensitivity to gradual accumulations in the filter.

Accordingly, a drying appliance equipped to detect the clogging of one or more lint filters would be useful. Such an appliance equipped to take one or more corrective actions once clogging to the lint filter is detected would be particularly useful.

BRIEF DESCRIPTION OF THE INVENTION

Additional aspects and advantages of the invention will be set forth in part in the following description, or may be apparent from the description, or may be learned through practice of the invention.

In one exemplary aspect, the present invention provides a method of operating an appliance used for drying a load of articles placed into a compartment of the appliance. The method can include beginning a drying cycle for the load of articles; determining when a steady state condition has been reached during the drying cycle for the load of articles; measuring temperature and relative humidity of air supplied to the compartment during the steady state condition; measuring temperature and relative humidity of air received from the compartment during the steady state condition; assessing a moisture extraction rate from the load or articles during the steady state condition; ascertaining an amount of moisture per unit volume of air removed from the load of articles in the compartment during the steady state condition; and calculating the airflow rate of air during the steading state condition using the previously assessed moisture extraction rate and the previously ascertained amount of moisture per unit volume of air removed from the load of articles in the compartment.

In another exemplary embodiment, the present invention provides a laundry appliance that includes a cabinet and a drum located in the cabinet that defines a compartment for receipt of articles for drying during a drying cycle. A conditioning system is connected with an air flow path and configured to supply air to the compartment to vaporize moisture from articles in the compartment and is also configured to receive the air from the compartment after contact with the articles. The appliance can include means for determining an average moisture extraction rate from articles placed in the compartment, a first temperature sensor for measuring the temperature of the air supplied to the compartment; a first relative humidity sensor for measuring the relative humidity of the air supplied to the compartment; a second temperature for measuring the temperature of the air received from the compartment; a second relative humidity sensor for measuring the relative humidity of the air received from the compartment; and a controller.

In an exemplary aspect, the controller may be configured for determining when a steady state condition has been reached during the drying cycle for the load of articles; receiving temperature and relative humidity measurements from for the air supplied to the compartment and for air received from the compartment during the steady state condition; assessing a moisture extraction rate from the load or articles during the steady state condition; ascertaining an amount of moisture per unit volume of air removed from the load of articles in the compartment during the steady state condition; and calculating the airflow rate of air during the steading state condition using the previously assessed moisture extraction rate and the previously ascertained amount of moisture per unit volume of air removed from the load of articles in the compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
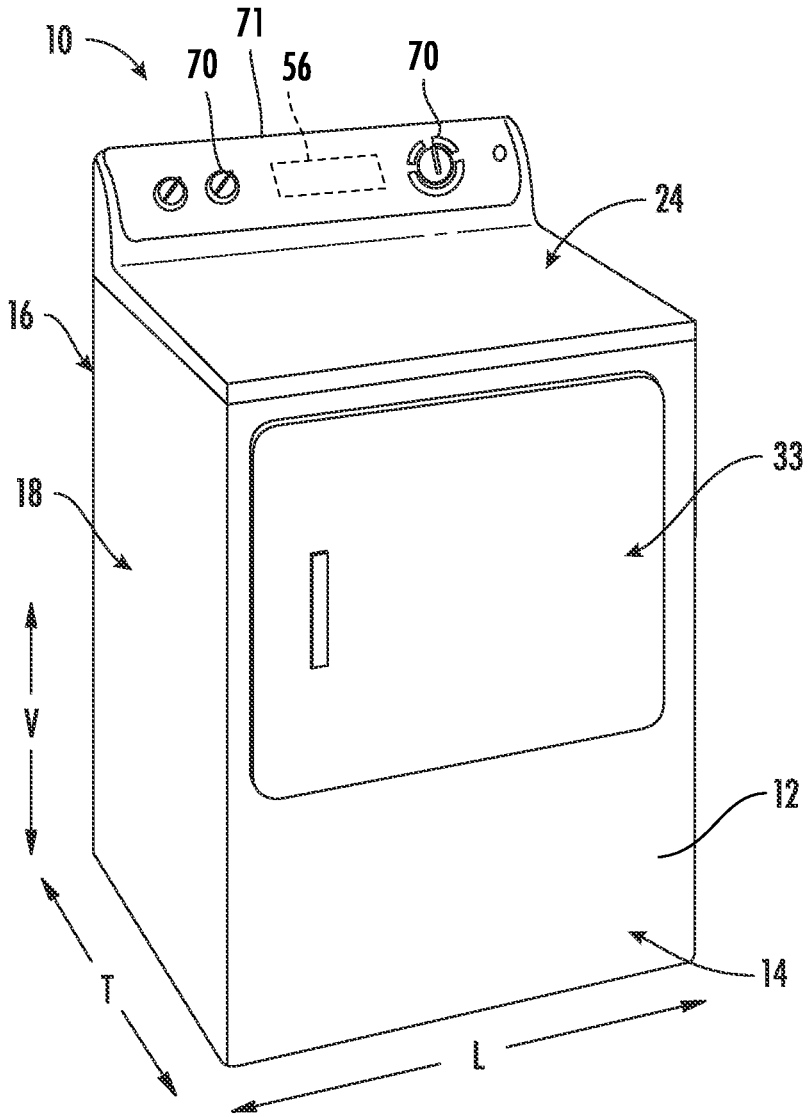
FIG. 1 provides a perspective view of a laundry appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
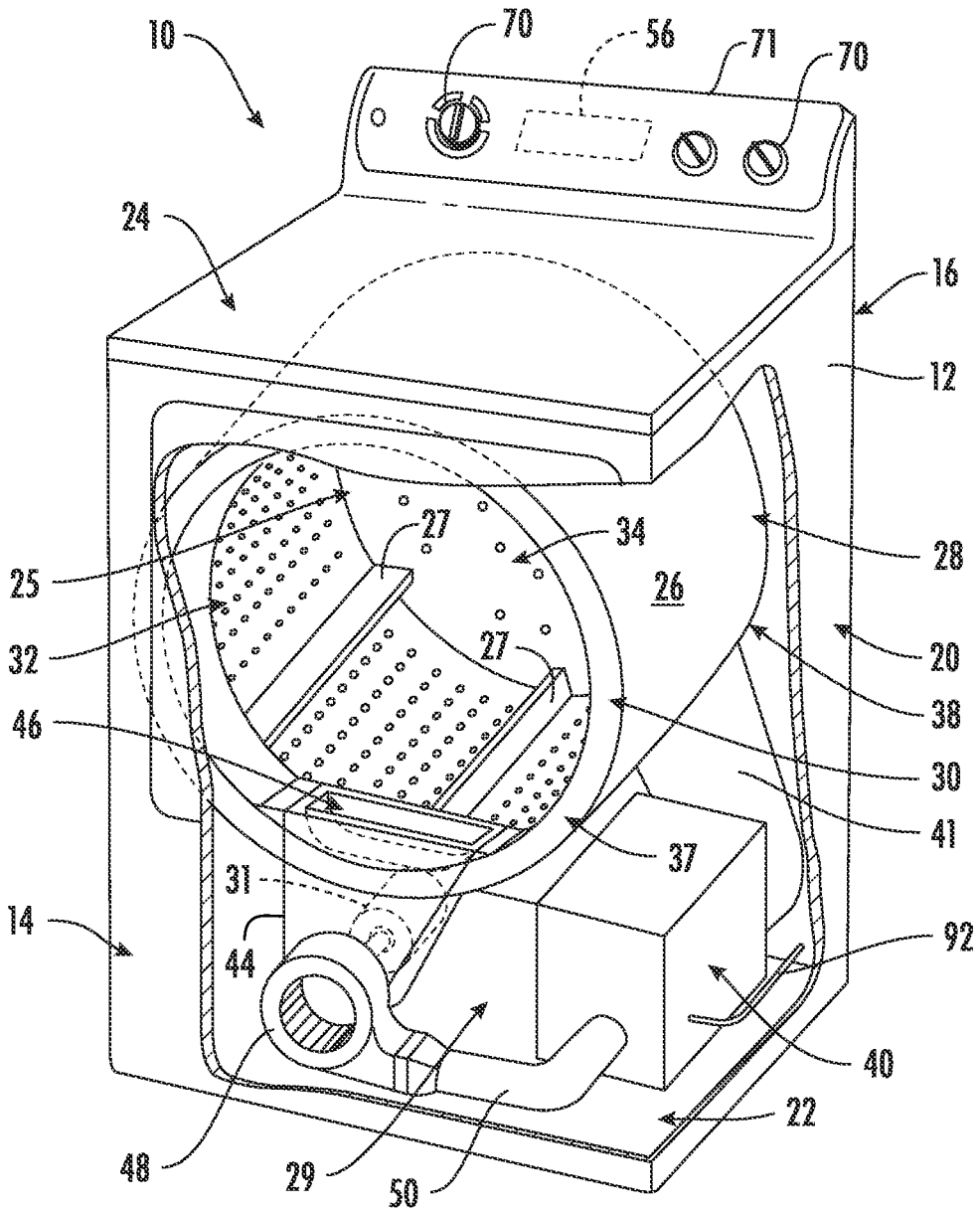
FIG. 2 provides a perspective view of the exemplary laundry appliance of FIG. 1 with portions of a cabinet of the laundry appliance removed to reveal certain components of the laundry appliance.

FIGS. 1 and 2 provide perspective views of a laundry appliance 10 according to exemplary embodiments of the present disclosure. Laundry appliance 10 is a dryer appliance for drying a load of articles in the illustrated embodiments and may also, in additional embodiments, include features for washing articles. For example, laundry appliance 10 may also, or instead, be a combination laundry appliance. In particular, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10.

As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other laundry appliances having different appearances and different features may also be utilized with the present subject matter as well. For instance, in some embodiments, laundry appliance 10 can be a combination washing machine/dryer appliance or a condensing laundry drying appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum, or container 26 is mounted for rotation about a substantially horizontal axis within the interior volume 29 of cabinet 12. Drum 26 defines a compartment or chamber 25 for receipt of articles for tumbling and/or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined in rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing or articles that may be washed together in a washing machine or dried together in a dryer appliance (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40, e.g., a heat pump or refrigerant-based conditioning system as will be described further below. Moisture laden, heated air is drawn from drum 26 by an air handler, such as a blower fan 48, which generates a negative air pressure within drum 26. The moisture laden heated air passes through a duct 44 enclosing screen filter 46, which traps lint particles. Other filters or placements of filter 46 may also be utilized in the scope of the invention and claims that follow.

As the air passes from blower fan 48, it enters a duct 50 and then is passed into conditioning system 40. In some embodiments, dryer appliance 10 is a heat pump dryer appliance and thus conditioning system 40 may be or include a heat pump including a sealed refrigerant circuit, as described in more detail below with reference to FIG. 3. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) at least one processing device or controller 56. Controller 56 may also be communicatively coupled with various operational components of dryer appliance 10, such as motor 31, blower 48, components of conditioning system 40, and various sensors (e.g., temperature, relative humidity, and weight) as will be further described. In turn, signals generated in controller 56 direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

Figure 3:
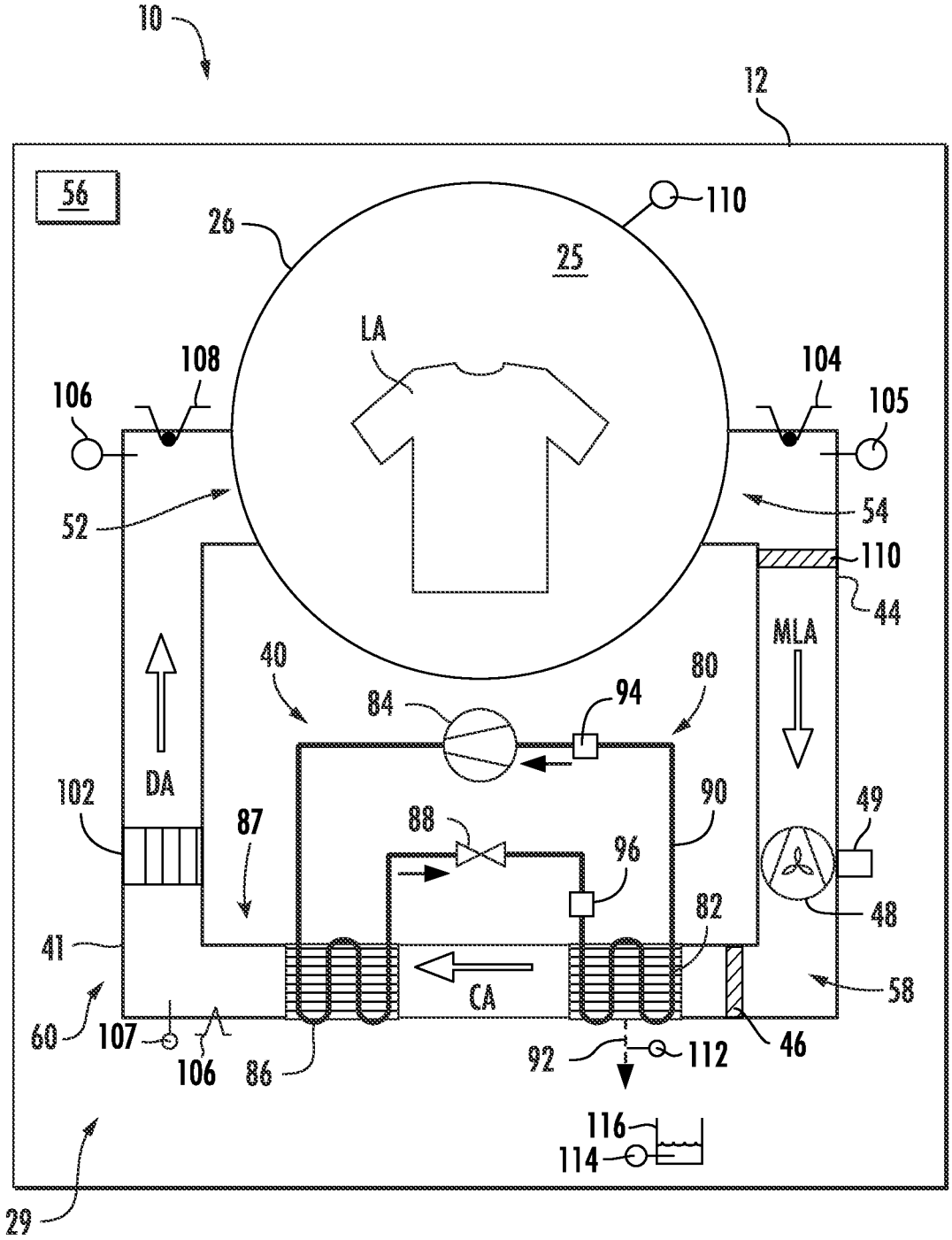
FIG. 3 provides a schematic diagram of an exemplary heat pump laundry appliance and a conditioning system thereof in accordance with exemplary embodiments of the present disclosure.

FIG. 3 provides a schematic view of laundry appliance 10 and depicts an air conditioning system 40 in more detail. For this exemplary embodiment, laundry appliance 10 is a heat pump dryer appliance and thus conditioning system 40 includes a sealed system 80. In additional embodiments, the conditioning system 40 illustrated in FIG. 3 and described herein may also be provided in, for example, a combination washing machine/dryer appliance. In other embodiments, the present invention is not limited to laundry appliance having a sealed system and may be used e.g., with a system that vents moisture laden air out of appliance 10.

Continuing with FIG. 3, sealed system 80 includes various operational components, which can be encased or located within a machinery compartment of dryer appliance 10. Generally, the operational components are operable to execute a vapor compression cycle for heating and cooling process air passing through conditioning system 40. The operational components of sealed system 80 include an evaporator 82, a compressor 84, a condenser 86, and one or more expansion devices 88 connected in series along a refrigerant circuit or line 90. In the illustrated embodiments, the expansion device 88 is an expansion valve, such as an electronic expansion valve. Refrigerant line 90 is charged with a working fluid, which in this example is a refrigerant. Sealed system 80 depicted in FIG. 3 is provided by way of example only. Thus, it is within the scope of the present subject matter for other configurations of the sealed system to be used as well. For example, in some embodiments, the expansion device 88 may also, or instead, include a capillary tube. As will be understood by those skilled in the art, sealed system 80 may include additional components, e.g., at least one additional evaporator, compressor, expansion device, and/or condenser. As an example, sealed system 80 may include two (2) evaporators.

In some embodiments, the sealed system 80 may optionally include one or more sensors for measuring characteristics and operating conditions of the sealed system 80. For example, the sealed system 80 may include a suction line temperature sensor 94, e.g., upstream of the compressor 84. As another example, the sealed system 80 may include an evaporator inlet temperature sensor 96 positioned at an inlet of the evaporator 82 and configured to measure a temperature of the refrigerant at the inlet of the evaporator 82.

In performing a drying and/or tumbling cycle, one or more laundry articles LA may be placed within the chamber 25 of drum 26. Hot dry air DA is supplied to chamber 25 via duct 41. The hot dry air DA enters chamber 25 of drum via a drum inlet 52 defined by drum 26, e.g., the plurality of holes defined in rear wall 34 of drum 26 as shown in FIG. 2. The hot dry air DA provided to chamber 25 causes moisture (e.g., water) within laundry articles LA to evaporate. Accordingly, the air within chamber 25 increases in water content and exits chamber 25 as warm moisture laden air MLA. The warm moisture laden air MLA exits chamber 25 through a drum outlet 54 defined by drum 26 and flows into duct 44.

After exiting chamber 25 of drum 26, the warm moisture laden air MLA flows downstream to conditioning system 40. Blower fan 48 moves the warm moisture laden air MLA, as well as the air more generally, through a process air flow path 58 defined by drum 26, conditioning system 40, and the duct system 60. Thus, generally, blower fan 48 is operable to move air through or along the process air flow path 58. Duct system 60 includes all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along duct system 60.

As further depicted in FIG. 3, the warm moisture laden air MLA flows into or across evaporator 82 of the conditioning system 40. As the moisture laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture laden air MLA—thereby reducing its temperature. As a result, moisture in the air is condensed and such condensate (e.g., water) may be drained from conditioning system 40, e.g., using a drain line 92, which is also depicted in FIG. 2.

Air passing over evaporator 82 becomes cooler than when it exited drum 26 at drum outlet 54. As shown in FIG. 3, cool air CA (cool relative to hot dry air DA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air DA for resupply to drum 26 of dryer appliance 10 through inlet 52. The warm dry air DA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers where all or most of the warm, moisture laden air MLA is exhausted to the environment.

In some embodiments, conditioning system 40 of dryer appliance 10 optionally includes an electric heater 102 positioned to provide heat to process air flowing along the process air flow path 58, e.g., as shown in FIG. 3. Electrical heater 102 can receive electrical power (e.g., from a power source) and can generate heat based at least in part on the received electrical power. The generated heat can be imparted to the process air flowing along the process air flow path 58.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion valve 88. Expansion valve 88 lowers the pressure of the refrigerant and controls the amount of refrigerant that is allowed to enter the evaporator 82. The flow of liquid refrigerant into evaporator 82 is limited by expansion valve 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flow path 58 while the refrigerant is cycled through sealed system 80, as described above. Although dryer appliance 10 is depicted and described herein as a heat pump dryer appliance, in at least some embodiments, dryer appliance 10 can be a combination washer/dryer appliance as previously stated.

For this exemplary embodiment, the electronic expansion valve 88 can be operable to adjust a pressure of the refrigerant flowing along sealed system 80. For example, controller 56 may be configured to cause the electronic expansion valve 88 to adjust the pressure of the refrigerant flowing along the sealed system 80. For instance, the electronic expansion valve 88 can be moved from a first position to a second position which is a closed position or an intermediate position (e.g., not fully open or fully closed) which is closer to the closed position than the first position. This can increase the pressure on the high side of sealed system 80 and decrease the pressure on the low side of sealed system 80. Accordingly, the temperature of the refrigerant increases on the high side of sealed system 80 and the temperature of the refrigerant decreases on the low side of sealed system 80. That is, adjustment of the electronic expansion valve can drive higher temperatures in condenser 86 and can lower the temperature of the evaporator 82.

Further, adjustment of the electronic expansion valve 88 can maintain a constant superheat in the sealed system 80 and in particular a constant level of superheat into the compressor 84, such as to avoid liquid refrigerant reaching the compressor 84. For example, the controller 56 may be configured to automatically adjust the electronic expansion valve 88 to maintain a constant degree of superheat into the compressor 84. As the degree of superheat in the sealed system 80 decreases, e.g., when the remaining moisture content in the laundry articles LA is below a certain level or threshold, the electronic expansion valve 88 may be closed (or partially closed, e.g., moved to an intermediate position which is closer to the closed position than a prior position) to restrict the flow of refrigerant in the sealed system 80. Thus, in some embodiments, the degree of superheat in the sealed system 80 and therefore the dryness of the laundry articles LA may be determined based on the position of the electronic expansion valve 88. For example, the laundry appliance 10 may include a position sensor or other expansion valve position tracking system which may be used to determine the position of the electronic expansion valve 88 and thereby determine or detect dryness of the laundry articles LA based on the position of the electronic expansion valve 88.

As shown, appliance 10 may include one or more lint filters 46 and 110 to collect lint during drying operations. By way of example, lint filter 46 is readily accessible by a user of the appliance. As such, lint filter 46 should be manually cleaned by removal of the filter, pulling or wiping away accumulated lint, and then replacing the filter 46 for subsequent drying cycles. Alternatively, or in addition to lint filter 46, appliance 10 may include one or more of an auto-cleaning lint filter 110 that is automatically cleaned at certain times as part of the operation of appliance 10. Each of these filters 46 and 110 is placed into the path 58 of air flow through appliance 10 and includes a screen, mesh, other material to capture lint in the air flow. The location of lint filters in appliance 10 as shown in FIG. 3 is provided by way of example only, and other locations may be used as well.

With continued reference to FIG. 3, appliance 10 includes temperature sensors and relative humidity sensors that provide temperature (e.g., dry bulb temperature) and humidity measurements to controller 56 from certain locations in the air flow along path 58 during a drying cycle. More particularly, appliance 10 includes a temperature sensor 104 and a relative humidity sensor 105 placed at the outlet 54 of drum 26 (having compartment 25 for receipt of a load of articles for drying) in order to measure the temperature and relative humidity of the air exiting drum 26. Such air is received from compartment 25 and may be MLA or moisture laden air, particularly in the earlier time period of a drying cycle of wet laundry articles. In this embodiment, in terms of the air flow along path 58, temperature sensor 104 and relative humidity sensor 105 are downstream of drum 26 and upstream of evaporator 82. Based on their location relative to drum 26 and the direction of air flow, temperature sensor 104 and relative humidity sensor 105 may also be referred to herein as the drum outlet air temperature sensor 104 and drum outlet air relative humidity sensor 105.

Appliance 10 also includes a temperature sensor 106 and a relative humidity sensor 107 placed upstream of the drum 26 and at the outlet 87 of condenser 86 to measure the temperature and relative humidity of the after treatment by condenser 86 and before entering drum 26. Such air is supplied to compartment 25 and may be DA or relatively dry air from which water vapor has been removed as previously described. Based on their location relative to drum 26 and the direction of air flow, temperature sensor 106 and relative humidity sensor 107 may also be referred to herein as the condenser air outlet temperature sensor 106 and the condenser air outlet relative humidity sensor 107.

As an alternative, or in addition thereto, appliance 10 may include another placement of a temperature sensor and/or relative humidity sensor for measurements of air that is suppled to compartment 25—placement that is downstream of condenser 86 and located just before entering drum 26. As shown in FIG. 3, appliance 10 may include a temperature sensor 108 and relative humidity sensor 109 placed at the inlet 52 of drum 26. Based on their location relative to drum 26 and the direction of air flow, temperature sensor 108 and relative humidity sensor 109 may also be referred to herein as the drum inlet air temperature sensor 108 and drum inlet air relative humidity sensor 109.

Other locations for both temperature sensors 104, 106, 108 and relative humidity sensors 105, 107, and 109 may also be used provided that such allows for measurement of the temperature and relative humidity of air supplied to, and air received from, compartment 25 of drum 26.

Figure 4:
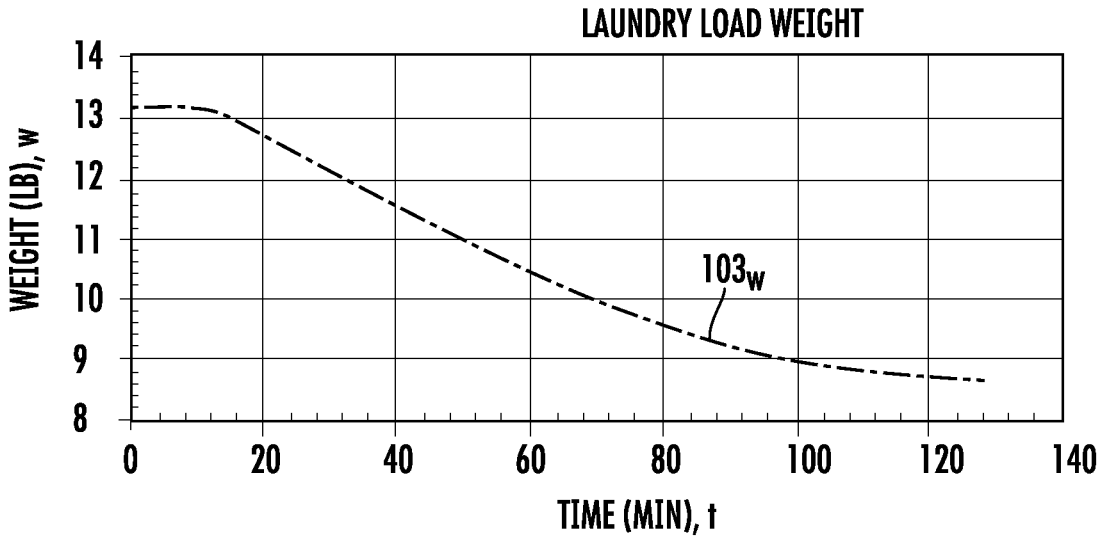
FIGS. 4, 6, and 7 provide plots of laundry load weight, air temperature, and relative humidity, respectively, during operation of an exemplary appliance of the present invention during a drying cycle with a laundry load present in the drum of the appliance.

Appliance 10 also includes means for determining the average moisture extraction rate (MER) from a load of laundry articles place in the compartment 25 of drum 26 during a drying cycle. The average moisture extraction rate or MER will be understood as the average rate of removal of moisture from articles in drum 26 by the air circulated therethrough during a drying cycle. For example, appliance 10 may include a load sensor 110 on drum 26. Load sensor can measure the weight w of laundry articles place in drum 26 at certain times t over the course of a drying cycle and provide this information to controller 56. As moisture is removed from the laundry articles during the drying cycle, the weight of laundry articles in drum 26 will decrease. This is illustrated in FIG. 4, which depicts the weight w of a laundry load in drum 26 over time t during a drying cycle for appliance 10. Controller 56 can calculate an average MER by dividing the change in weight of the laundry articles by the elapsed time during which such weight changed occurred, as represented by Equation 1:

$$\text{average MER}=(w_2-w_1)/(t_2-t_1) \qquad \text{Eq. 1—average MER}$$

The average MER may, for example, be expressed as pounds of water per minute, kilograms per second, or other mass per time units that may be used as well. Notably, as shown in FIG. 4, the average MER (e.g., the slope of curve $\mathbf{103}_W$) becomes relatively constant once steady state conditions are reached.

Alternatively, for determining an average MER, in another exemplary aspect appliance 10 may use a flow meter 112 that measures the volumetric flow of condensate from drain line 92 and provides the same to controller 56. In still another exemplary aspect, condensate from evaporator 82 may be collected in a reservoir 116 and a pressure sensor or float 114 would measure the amount of condensate collected over a given time interval or determine when a predetermined amount of condensate has been collected in reservoir 116 and provide such information to controller 56. Using the teachings disclosed herein, one of skill in the art will understand that other techniques may also be used to determine the average MER.

Figure 5:
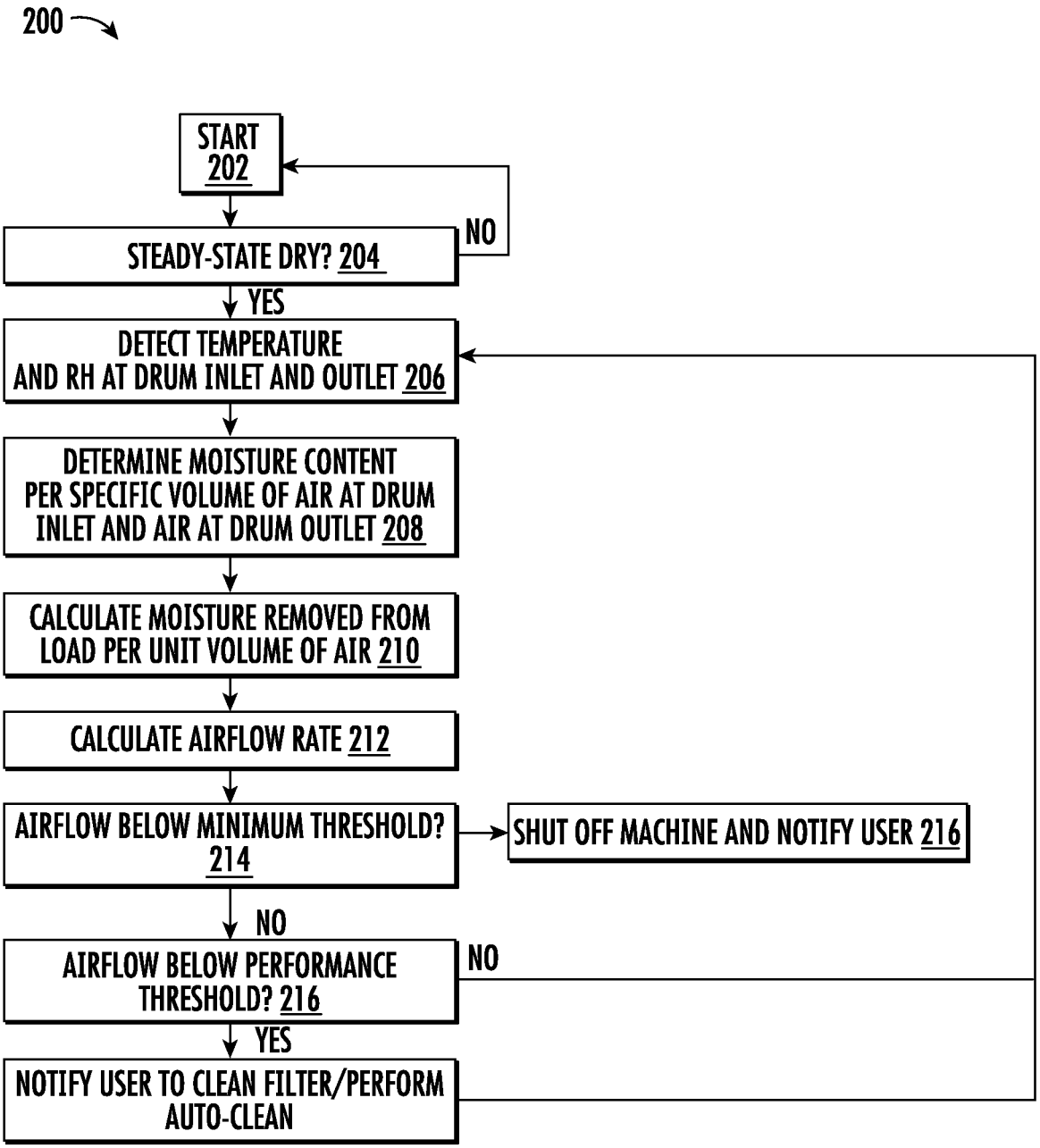
FIG. 5 is a diagram of an exemplary method of operating an exemplary appliance of the present invention.

As previously mentioned, filters 46 and/or 110 can accumulate lint and eventually create an undesirable pressure drop during operation of appliance 10. In one exemplary aspect, the present invention utilizes a direct calculation of the volumetric airflow rate (VAR) through drum 26 to determine the condition of the one or more lint filters in air flow path 58. Based on the determination of airflow rate or VAR, one or more actions may be undertaken by controller 56. Referring to FIG. 5, an exemplary method of 200 operating appliance 10 to determine the volumetric airflow rate through drum 26 will now be described. Using the teachings disclosed herein, one of ordinary skill in the art will understand that other methods within the scope of the invention and claims that follow may be applied as well to determine the volumetric airflow rate through drum 26.

After start 202 of a drying cycle for appliance 10, a determination is made in step 204 at a time after start-up of the drying cycle as to whether steady state conditions in appliance 10 have been reached. For this exemplary embodiment of the invention, determining steady state conditions have been reached can be important for purposes of calculating the volumetric airflow rate (VAR) so that changes in the airflow rate can be attributed to clogging of the filter instead of being affected by transient changes that occur before appliance 10 reaches steady state.

Figure 6:
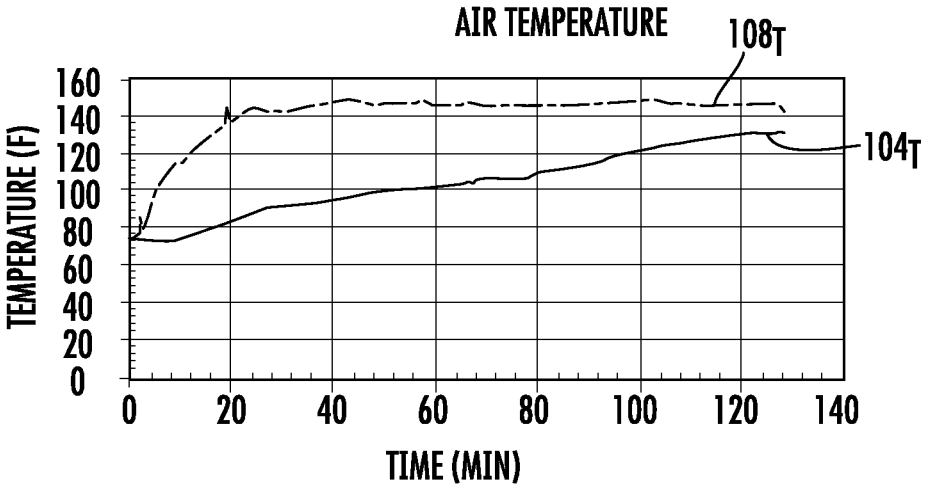
Figure 7:
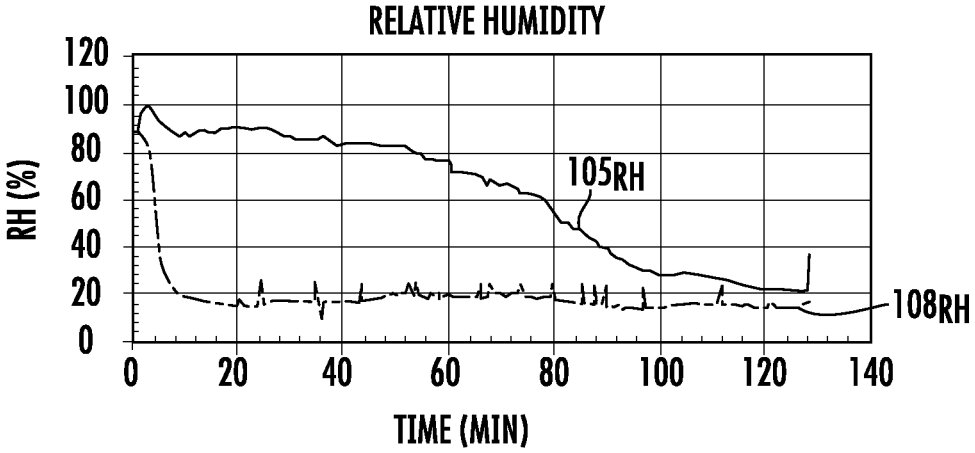

During a drying cycle of appliance 10 with a laundry load present in compartment 25 of drum 26, FIG. 6 depicts the temperature measurements $\mathbf{108}_T$ from drum inlet air temperature sensor 108 and temperature measurements $\mathbf{104}_T$ from drum outlet air temperature sensor 104. For the same drying cycle as FIG. 6, FIG. 7 depicts the relative humidity (RH) measurements $\mathbf{109}_{RH}$ from drum inlet air relative humidity sensor 109 and relative humidity (RH) measurements $\mathbf{105}_{RH}$ from drum outlet air relative humidity sensor 105. As shown in FIG. 6, temperature measurements $\mathbf{108}_T$ from drum inlet air temperature sensor 108 changed rapidly during the first approximately 20 minutes of the drying cycle. The relative humidity measurements $\mathbf{109}_{RH}$ from drum inlet air relative humidity sensor 109 also changed rapidly during the first approximately 10 minutes of the drying cycle.

One or both of the measurements depicted in FIGS. 6 and 7 may be used by appliance 10, and specifically controller 56, to determine when steady conditions have been reached. For example, controller 56 may be configured to simply delay a predetermined period of time $t_{initial}$ after appliance 10 has been operating before undertaking to determine the volumetric airflow rate (VAR). In one embodiment, $t_{intial}$ might be preset as 20 minutes, after which in step 202 the controller 56 proceeds under the assumption of steady-state conditions. Other time periods for $t_{initial}$ may be used as well.

In another embodiment, controller 56 would determine whether the rate of change (ROC) of the temperature measurements $\mathbf{108}_T$, relative humidity measurements $\mathbf{109}_{RH}$, or both, has fallen below certain predetermined threshold values. As used herein, rate of change or ROC means the change in a measured value of a certain interval of time. For example, as indicative of a steady state condition being reached, controller 56 might monitor the temperature, relative humidity, or both, of air supplied to compartment or drum 26 to determine when the rate of change has reached or dropped below a predetermined threshold value, $ROC_{THR}$. In one embodiment, controller 56 may monitor temperature measurements $\mathbf{108}_T$ and determine that a steady condition in drum 26 has not been reached until the rate of change (ROC) for temperature measurements $\mathbf{108}_T$ is less than an $ROC_{THR\text{-}T}$ of 5 degrees per minute, less than 3 degrees per minute, or less than 1 degree per minute. Other values for $ROC_{THR}$ may be used as well.

In still another example, controller 56 may monitor relative humidity measurements $\mathbf{109}_{RH}$ and determine that a steady condition in drum 26 has not been reached until the rate of change (ROC) for relative humidity measurements $\mathbf{109}_{RH}$ is less than an $ROC_{THR\text{-}RH\ of}$ 10 percent per minute, less than 5 percent per minute, or less than 1 percent per minute. Other values for $ROC_{THR}$ may be used as well. In still another embodiment, controller 56 might monitor both temperature and relative humidity measurements until the ROC for both the temperature measurements $\mathbf{108}_T$ and relative humidity measurements $\mathbf{109}_{RH}$ are each below certain predetermined threshold values, $ROC_{THR}$. By way of further example, controller 56 might also use measurements from sensors 106 and 107 in addition to, or instead of, measurements from sensors 108 and 109.

At about the same time or shortly after steady state conditions are determined, in step 206 controller 56 detects the temperature and relative humidity at the inlet 52 and outlet of drum 26. For example, for a given moment in time $t_x$, controller 56 receives a temperature measurement $\mathbf{108}_T$ from drum inlet air temperature sensor 108 and receives a relative humidity measurement $\mathbf{109}_{RH}$ from drum inlet air relative humidity sensor 109. At about the same time $t_x$, controller 56 also receives a temperature measurement $\mathbf{104}_T$ from drum outlet air temperature sensor 104 and receives a relative humidity measurement $\mathbf{105}_{RH}$ from drum outlet air relative humidity sensor 105.

In step 208, this measured data from the air flowing into, and out of, drum 26 is used to determine the amount of moisture (e.g., water) present per volume of air for both the inlet air and outlet air. More particularly, the air pressure at the inlet 52 and outlet 54 of drum are both assumed to be atmospheric or at 1 ATM because the pressure drop between the inlet and outlet is negligible. As will be understood by one of ordinary skill in the art, psychrometric data for water vapor (i.e. air and water) at a given pressure such as 1 ATM are well known and available.

Figure 8:
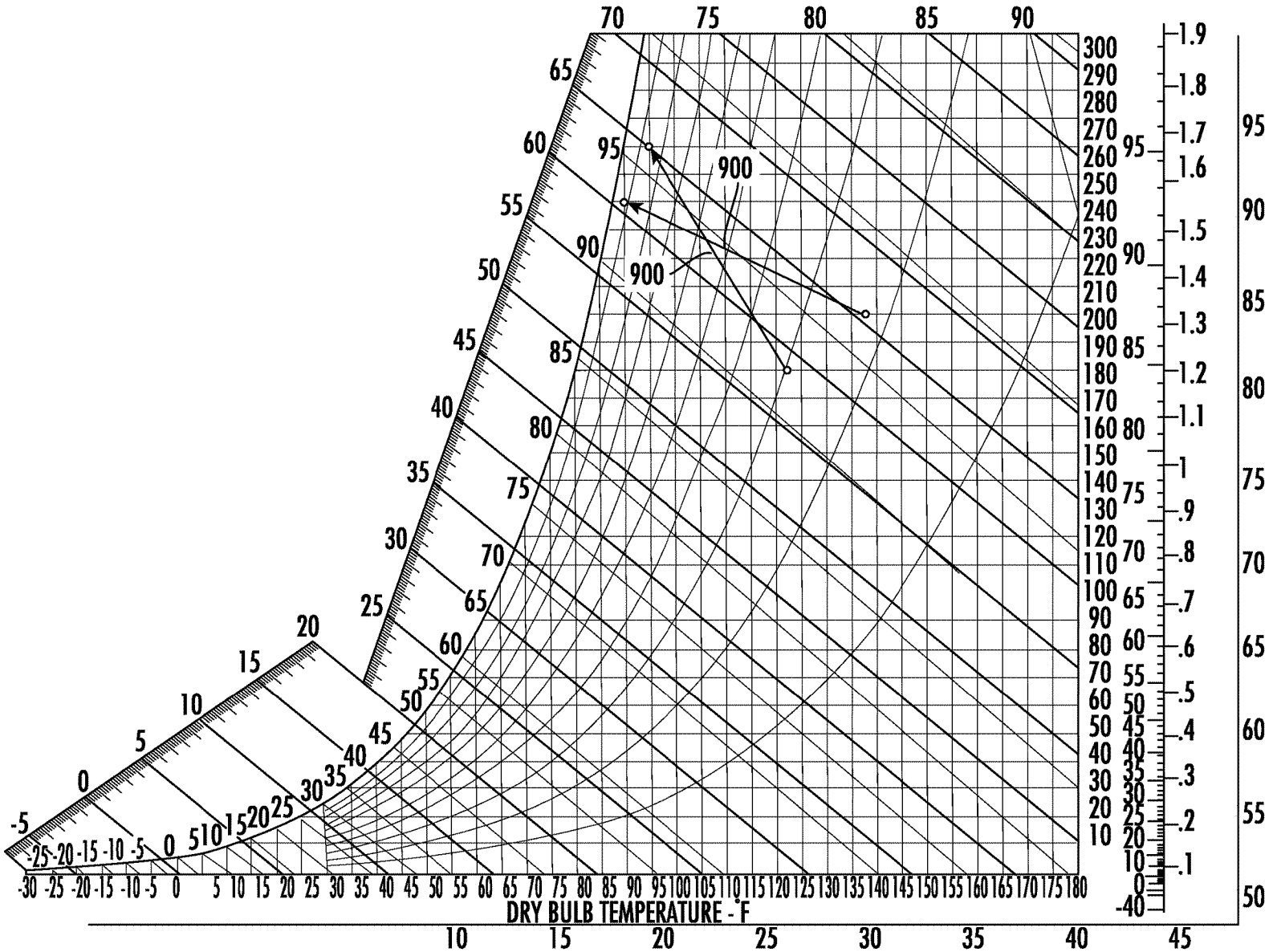
FIG. 8 is an exemplary plot of psychrometric data for water at one atmosphere pressure as may be used with the present invention.

By way of example, FIG. 8 provides a representative psychrometric chart for water vapor at 1 ATM (Linric Company Psychrometic Chart, www.linric.com). Other psychrometric charts or data tables for water vapor may be used as well. Controller 56 can be provided with, or in communication with, one or more storage or memory units containing such data. Using such psychrometric data, the amount of water present per volume of dry air can be determined for a given dry bulb temperature T and relative humidity RH. For example, the amount of moisture per cubic feet of dry air as represented below in Equation 2 can be determined for both the air at inlet 52 and the air at outlet 54 using the psychrometric data found in FIG. 8:

moisture per cubic foot of dry air — Eq. 2

$$\frac{\text{lb water}}{\text{ft}^3\text{ dry air}} = \frac{\text{humidity ratio}}{\text{specific volume}} = \frac{\omega}{v}$$

For example, using FIG. 8, for a temperature of 145° F. and a relative humidity of 20 percent, the value of moisture per cubic foot of dry air (w/v) would be about 0.0018 pounds moisture per cubic foot of dry air.

Next, in step 210, the amount of moisture or water removed per cubic foot of dry air flowing through compartment 25 of drum 26 (Δ w/v) can be determined by subtracting the amount of moisture per cubic feet of dry air determined for the air at inlet 52 from the amount of moisture per cubic feet of dry air determined for the air at outlet 54 as represented below in Equation 3:

moisture removed per volume of dry air — Eq. 3

$$\Delta w/v = \frac{\text{lb water removed}}{\text{ft}^3\text{ dry air}} = \left(\frac{\omega}{v}\right)_{out} - \left(\frac{\omega}{v}\right)_{in}$$

The volumetric airflow rate (VAR) through drum 26 at time $t_x$ ($VARt_x$) is then directly calculated in step 212 by dividing the difference from Equation 3 (the amount of moisture or water removed per cubic foot of dry air removed in drum 26) by the average MER during steady state conditions as discussed above with reference to Equation 1. This is represented in Equation 4:

Volumetric airflow rate $VAR$ — Eq. 4

$$VAR = MER \div \Delta w/v$$

$$\frac{\text{ft}^3\text{ dry air}}{\text{min}} - \frac{\text{lb water}}{\underbrace{\text{min}}_{\boxed{MER}}} \div \frac{\text{lb water removed}}{\text{ft}^3\text{ dry air}}$$

Having determined the volumetric airflow rate through drum 26 directly using steps such as those just described, controller 56 of appliance 10 can be configured to take one or more steps so that appliance 10 operates without undesirable restriction to the airflow due to one or more clogged lint filters such as filters 46 and 100.

For example, continuing with the exemplary method of FIG. 5, in step 214 controller 56 compares the calculated volumetric airflow rate at a given time $t_x$ ($VARt_x$) with a certain minimum threshold value $VAR_{MIN\text{-}OFF}$ to determine if appliance 10 should be shut off as in step 216. For example, $VAR_{MIN\text{-}OFF}$ might be a minimum airflow rate through drum 26 or path 58 that is necessary to prevent overheating of appliance 10 and damage thereto. If the volumetric airflow rate at a given time $t_x$ ($VARt_x$) is determined to be at or below this threshold $VAR_{MIN\text{-}OFF}$, then controller 56 may be configured to shut off appliance 10 and provide a notification to the user. Such notification may include one or more signals or alerts to the user that the lint filter(s) in appliance 10 need to be checked and cleaned.

Alternatively, or in addition thereto, in step 216 controller 56 may use the air flow rate at a given time $t_x$ ($VARt_x$) to determine whether one or more notifications should be provided to the user. For example, if $VARt_x$ is found to be at or below a certain minimum threshold value $VAR_{MIN\text{-}SIG}$, then the user might be notified that the lint filter(s), such as lint filters 46 and 110, need to be cleaned. In another embodiment of the invention, an automatic cleaning cycle might be initiated for auto-cleaning filter 110. Regardless, because $VARt_x$ is not at or below $AF_{MIN\text{-}OFF}$, controller 56 allows appliance 10 to continue operating. Meanwhile, as indicated in FIG. 5, controller 56 continues to monitor the airflow conditions—and therefore the condition of lint filters 46 and/or 100—by repeating steps 206 through 216 during the drying cycle.

The process set forth in FIG. 5 is exemplary and representative only. Using the description provided herein, one of ordinary skill in the art will understand that other steps may also be used within the scope of the invention and claims that follow. The order of certain steps may be changed and operations described or claimed as a single step herein may actually be executed in multiple steps or operations. The invention includes an appliance having one or more controllers, microprocessors and/or other elements configured to operate a drying appliance as previously described. Also, while exemplary aspects of the invention have been described using English units (e.g., in the equations above), such is by way of example only and one of skill in the art will understand that e.g., the International System of Units (SI) may be used as well.

Figure 9:
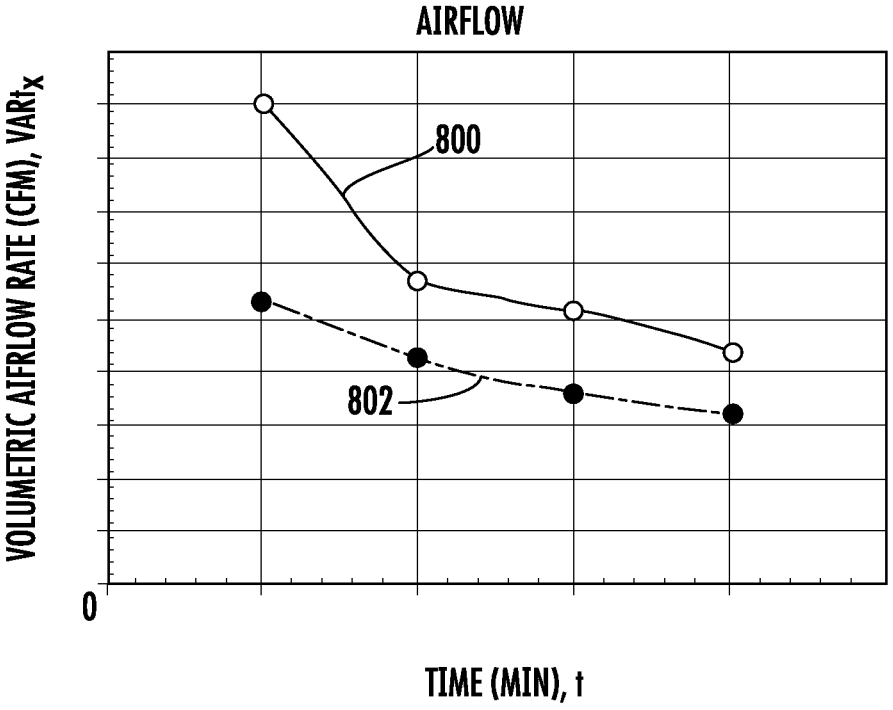
FIG. 9 illustrates a plot of the volumetric air flow as a function of time during a drying cycle of an exemplary appliance.

FIG. 9 illustrates a plot during a drying cycle of the volumetric air flow, $VARt_x$, directly determined as described above from MER and measurements of dry bulb temperature and relative humidity for a drying appliance having a heat pump system and at least one lint filter. Plot 800 represents a filter that was about 25 percent blocked whereas plot 802 represents a filter that was about 75 percent blocked (the percentages were determined relative to the desired unblocked airflow, which was considered to be 100 percent).

As expected, the volumetric flow rate $VARt_x$ is higher for the less clogged filter represent by plot 800, and the volumetric flow rate $VARt_x$ decreases over the time t of the drying cycle operation. Also, the difference in volumetric flow rate $VARt_x$ for plot 800 and 802 is substantial (>20 CFM), which is indicative of the sensitivity that can be achieved by the present invention for detecting lint filter clogging.

By way of further example, for this drying appliance 10, controller 56 might be programmed with an $VAR_{MIN\text{-}OFF}$ at 60 CFM (cubic feet per minute), 55 CFM, or 50 CFM. Other values for $VAR_{MIN\text{-}OFF}$ may be used as well in other embodiments of the invention. By way of example, for this drying appliance 10, controller 56 might be programmed with an $VAR_{MIN\text{-}SIG}$ of 80 CFM, 75 CFM, or 70 CFM. Other values for $VAR_{MIN\text{-}SIG}$ may be used as well in other embodiments of the invention.

Still other exemplary methods of operating appliance 10 may be employed with the present invention as will be understood using the teaching disclosed herein. For example, appliance 10 may be equipped with an oversized lint filter 46 that does need to be cleaned with every drying cycle. Instead, appliance 10 and particularly controller 56 may be configured to estimate when lint filter cleaning will be needed depending on variables such as load types and sizes. The degradation of the filter 46 can be correlated to the degree of filter loading for various load types and sizes, which can be determined based on user selection and load size determination as previously described. When a remaining interval for cleaning of lint filter 46 is less than a certain threshold value, appliance 10 can alert the user that one or more lint filters or e.g., lint filter 46 must be cleaned.

Additionally, appliance 10 can use the volumetric airflow rate measurements previously described as a back-up or check for when the lint filter(s) must be cleaned. For example, if the volumetric air flow rate $VARt_x$ of a previous cycle falls below a threshold $VAR_{PREV}$, then controller 56 can provide an alert or notification to the user that the lint filter should be cleaned before starting another drying cycle. Such alert may be a visual and/or audible signal at the end of the previous drying cycle, could be provided when the user is about to initiate another drying cycle, or a combination thereof. Accordingly, a user drying various load types and sizes can receive customized alerts for when lint filter 46 must be cleaned, and appliance 10 can use direct measurements of the volumetric air flow rate $VARt_x$ as a check on the estimated intervals required for cleaning.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an appliance used for drying a load of articles placed into a compartment of the appliance, the method comprising:

beginning a drying cycle for the load of articles;

determining when a steady state condition has been reached during the drying cycle for the load of articles;

measuring temperature and relative humidity of air supplied to the compartment during the steady state condition;

measuring temperature and relative humidity of air received from the compartment during the steady state condition;

assessing a moisture extraction rate from the load or articles during the steady state condition;

ascertaining an amount of moisture per unit volume of air removed from the load of articles in the compartment during the steady state condition; and calculating the airflow rate of air during the steady state condition using the previously assessed moisture extraction rate and the previously ascertained amount of moisture per unit volume of air removed from the load of articles in the compartment.

2. The method of operating an appliance as in claim 1, wherein the determining comprises delaying a predetermined time period after beginning the drying cycle for the load of articles.

3. The method of operating an appliance as in claim 1, wherein the determining comprises monitoring the temperature of air supplied to the compartment until a rate of change of the temperature of air suppled to the compartment is less than a predetermined threshold value.

4. The method of operating an appliance as in claim 1, wherein the determining comprises monitoring the relative humidity temperature of air supplied to the compartment until a rate of change of the relative humidity of air suppled to the compartment is less than a predetermined threshold value.

5. The method of operating an appliance as in claim 1, wherein the determining comprises monitoring the temperature of air supplied to the compartment until a rate of change of the temperature of air suppled to the compartment is less than a predetermined threshold value and further comprises monitoring the relative humidity temperature of air supplied to the compartment until a rate of change of the relative humidity of air suppled to the compartment is also less than another predetermined threshold value.

6. The method of operating an appliance as in claim 1, wherein the ascertaining comprises determining psychrometric properties of the air supplied to the compartment and the air received from the compartment.

7. The method of operating an appliance as in claim 1, wherein the ascertaining comprises determining a moisture content per specific volume of air suppled to the compartment and determining a moisture content per specific volume of air received from the compartment.

8. The method of operating an appliance as in claim 7, wherein the ascertaining further comprises calculating a difference between the moisture content per specific volume of air suppled to the compartment and the moisture content per specific volume of air received from the compartment.

9. The method of operating an appliance as in claim 1, further comprising stopping the drying cycle if the airflow rate is at or below a predetermined minimum threshold value.

10. The method of operating an appliance as in claim 9, further comprising providing a notification if the airflow rate is at or below a predetermined minimum threshold value.

11. The method of operating an appliance as in claim 1, further comprising providing a notification, while continuing the drying cycle, if the airflow rate is at or below a predetermined minimum threshold value.

12. The method of operating an appliance as in claim 1, further comprising providing a notification, before beginning a drying cycle, if the airflow rate from a previous drying cycle is at or below a predetermined minimum threshold value.

13. A laundry appliance, comprising:

a cabinet;

a drum located in the cabinet and defining a compartment for receipt of articles for drying during a drying cycle;

a conditioning system connected with an air flow path and configured to supply air to the compartment to vaporize moisture from articles in the compartment and also configured to receive the air from the compartment after contact with the articles;

means for determining an average moisture extraction rate from articles placed in the compartment;

a first temperature sensor for measuring the temperature of the air supplied to the compartment;

a first relative humidity sensor for measuring the relative humidity of the air supplied to the compartment;

a second temperature for measuring the temperature of the air received from the compartment;

a second relative humidity sensor for measuring the relative humidity of the air received from the compartment; and a controller configured for determining when a steady state condition has been reached during the drying cycle for the load of articles;

receiving temperature and relative humidity measurements from for the air supplied to the compartment and for air received from the compartment during the steady state condition;

assessing a moisture extraction rate from the load or articles during the steady state condition;

ascertaining an amount of moisture per unit volume of air removed from the load of articles in the compartment during the steady state condition; and calculating the airflow rate of air during the steady state condition using the previously assessed moisture extraction rate and the previously ascertained amount of moisture per unit volume of air removed from the load of articles in the compartment.

14. The laundry appliance as in claim 13, wherein the controller is further configured for delaying a predetermined time period after beginning of the drying cycle.

15. The laundry appliance as in claim 13, wherein the controller is further configured for monitoring the temperature of air supplied to the compartment until a rate of change of the temperature of air suppled to the compartment is less than a predetermined threshold value.

16. The laundry appliance as in claim 13, wherein the controller is further configured for monitoring the relative humidity temperature of air supplied to the compartment until a rate of change of the relative humidity of air suppled to the compartment is less than a predetermined threshold value.

17. The laundry appliance as in claim 13, wherein the controller is further configured for monitoring the temperature of air supplied to the compartment until a rate of change of the temperature of air suppled to the compartment is less than a predetermined threshold value and further comprises monitoring the relative humidity temperature of air supplied to the compartment until a rate of change of the relative humidity of air suppled to the compartment is also less than another predetermined threshold value.

18. The laundry appliance as in claim 13, wherein the controller is further configured for determining psychrometric properties of the air supplied to the compartment and the air received from the compartment.

19. The laundry appliance as in claim 13, wherein the ascertaining comprises determining a moisture content per specific volume of air suppled to the compartment and determining a moisture content per specific volume of air received from the compartment.

20. The laundry appliance as in claim 13, wherein the controller is further configured for causing a notification, before beginning a drying cycle, if the airflow rate from a previous drying cycle is at or below a predetermined minimum threshold value.

* * * * *